United States Patent [19]

Lee

[11] 4,021,361

[45] May 3, 1977

[54] STORAGE-STABLE DETERGENT COMPOSITION CONTAINING SODIUM PERBORATE AND ACTIVATOR

[75] Inventor: Fui-Tseng H. Lee, Princeton, N.J.

[73] Assignee: FMC Corporation, Philadelphia, Pa.

[22] Filed: Aug. 25, 1975

[21] Appl. No.: 607,478

[52] U.S. Cl. ..... 252/102; 252/95; 252/99; 252/186; 260/326.38

[51] Int. Cl.[2] ..... C11D 7/54

[58] Field of Search ..... 252/99, 94, 95, 102, 252/186; 260/326.38, 593

[56] References Cited

UNITED STATES PATENTS

| | | | |
|---|---|---|---|
| 2,343,256 | 3/1944 | Hass et al. | 260/593 |
| 3,153,565 | 10/1964 | Dithmar et al. | 8/111 |
| 3,332,882 | 7/1967 | Blumbergs et al. | 252/186 |
| 3,816,319 | 6/1974 | Sarot et al. | 252/95 |
| 3,819,358 | 6/1974 | Poje et al. | 71/76 |

OTHER PUBLICATIONS

Lambert & Lowe, J. Chem. Soc. 1517, 1947, p. 42.

Noland and Sundberg, *Tetrahedron Letters*, No. 7, pp. 295–299, 1962.

Nightingale et al., J. Org. Chem., 28, 1963, pp. 642–646.

*Primary Examiner*—Mayer Weinblatt

*Attorney, Agent, or Firm*—Milton Zucker; Frank Ianno; Pauline Newman

[57] ABSTRACT

A storage-stable bleaching detergent composition is obtained by adding, to a typical solid detergent mix, sodium perborate or sodium carbonate peroxide as a bleaching agent, and from about 50% to about 100% of the weight of the sodium perborate of an activator of the group consisting of the acetylated adduct of nitromethane and cyclohexanone, and the acetylated adduct of nitromethane and cyclopentanone.

2 Claims, No Drawings

STORAGE-STABLE DETERGENT COMPOSITION CONTAINING SODIUM PERBORATE AND ACTIVATOR

This invention is concerned with the use of active oxygen bleaching agents for home laundry applications, and aims to provide a storage-stable detergent mixture which is useful in this area.

In the make-up of granular laundering compositions it is desired to add a solid bleaching agent to the formulation in order to obtain bleaching simultaneously with cleaning. The solid bleaching agent ideally must be one which is stable at room temperature, thereby assuring good shelf life, but which is capable of bleaching at the temperature normally employed in domestic washing machines. One class of compounds which approaches these requirements is the solid peroxygen compounds such as the alkali perborates and alkali carbonate peroxides. The difficulty with these solid bleaching agents is that they do not bleach effectively until temperatures of about 80° to 90° are employed. Since the temperature of the water in domestic washing machines does not normally rise above about 60° C and generally is much lower, the full bleaching effect of the peroxygen compound is not obtained.

In an effort to solve this difficulty, many "activators" have been suggested in the prior art in order to permit the active oxygen compounds, e.g. perborates or percarbonates to bleach effectively at lower temperatures. Many such activators have been suggested. Of these that are sufficiently effective to get results at the low temperatures used in typical home laundering, none have been found that do not attack the peroxygen compound during storage. It has been found necessary to coat the activator particles with a protective coating which keeps them out of contact with the peroxygen compound until the solid detergent is added to the water in the washing machine. A particularly effective activator is described and claimed in the Blumbergs et al U.S. Pat. No. 3,332,882, July 25, 1967; it is the triacetyl derivative of 2,4,6,trihydroxy-1,3,5-triazine, and is generally called by the acronym TACA. However it must be completely coated; the coating is an expensive and difficult operation; and storage failure results unless coating is complete.

I have discovered that superior storage stability can be obtained in detergent compositions containing sodium perborate or sodium carbonate peroxide as a bleaching agent in which the active oxygen compound is stable in the absence of activator, along with good bleaching activity at typical home laundering washing temperatures of 50° C, by adding to such compositions at least about 50 molar percent, per mol of sodium perborate or sodium carbonate peroxide, of a compound selected from the acetylated adducts of nitromethane with cyclohexanone or cyclopentanone.

In the preparation of compositions in accordance with this invention, I start with a storaage-stable mixture of a detergent and sodium perborate or sodium carbonate peroxide (SCP), both solid active oxygen compounds. The preparation of such mixtures presents no difficulty, since almost all of the commercially used solid detergents can be mixed with solid sodium perborate or SCP to give storage-stable products. Soap powders, and powdered anionic, cationic and non-ionic synthetic detergents can all be used. It is common practice to add detergent builders such as carbonates and especially phosphates to these solid detergents, as well as diluents such as sodium sulfate; these have no effect on the active oxygen compound during storage as solids. Such mixtures generally contain enough of the solid active oxygen compound to yield about 2 to 10 part per million of active oxygen in the washing machine when the correct amount of detergent is added. Obviously, the amounts of perborate or SCP used will depend on the particular detergent formulation -- typically, the perborate content, as sodium perborate tetahydrate, will range from 10% to 40% of the finished composition, and the SCP content from 7% to 28%, each yielding 15 to 60 ppm active oxygen.

The activator is added to the composition in amounts depending on the desired results. As little as about 50 molar percent of activator, based on active oxygen compound, will show marked improvement in bleaching at 50° C laundering temperatures, but results improve markedly up to about equimolar addition. Above this, somewhat improved results are obtained, but insufficient to be economic. The activators which I have found to be both active and storage-stable are the acetylated adducts of nitromethane and cyclohexanone or cyclopentanone.

Preparation of the cyclohexanone adduct is described by Lambert & Lower (J. Chem. Soc. 1517, 1947 p. 42); cyclohexanone and nitromenthane, catalyzed by secondary amines, yielded an unidentified adduct which has since been identified by Noland and Sundberg (Tetrahedron Letters No. 7 pp 295–299, 1962). An improved preparation of the cyclohexanone adduct is described by Nightingale et al (J. Org. Chem. 28, 1963, pp 642–646). The acetylated derivative of the adduct is a white powder -- m.p. 129° to 132° C, and is 14-acetoxy-14-azadispiro[5.1.5.2]pentadec-9-ene-15-one 7-oximinoacetate.

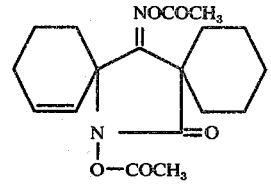

For the sake of brevity, the compound is hereinafter referred to as Acetate II.

I have prepared the analog by acetylating the adduct of cyclopentanone and nitromethane prepared in the manner described by Nightingale. It has a melting point of 178° to 180° C, and from its empirical formula $C_{14}H_{18}N_2O_4$, appears to be the monoacetylated adduct.

These acetylated adducts activate sodium perborate and SCP at typical home laundry temperature of 50° C, and the compositions appear to be storage-stable.

The following specific examples of the invention are illustrative of the invention, although are not to be deemed limiting thereof. They illustrate the effectiveness of the activators, and their storage stability.

Stain removal tests were carried out with tea stained cotton swatches (4 × 5 inches) using a Terg-O-Tometer made by the United States Testing Co., Inc. Hoboken, N.J. Procedure: In a Terg-O-Tometer vessel was placed on liter of 150 ppm hardness (as $CaCO_3$, 2/1 Ca to Mg ratio) water containing 0.15% of either a non-phosphate or phosphate-based laundry detergent. Where appropriate, sufficient sodium perborate or sodium carbonate peroxide (SCP) and activator were added to give the concentrations shown in the Examples. Three stained and three unstained desized cotton swatches were then added. The Terg-O-Tometer was then run at 100 cycles per minute for 30 minutes at the desired temperature. The swatches were removed from the wash solution, rinsed under cold tap water, then dried in a Kenmore Soft Heat electric clothes dryer for 20 minutes. Reflectance readings of the swatches were made before and after the Terg-O-Tometer test using a Hunter Model D-40 Reflectometer. Reported percentages tea stain removal were calculated according to the formula: ($\Delta R/40$) × 100 or (reflectance after bleaching-reflectance before bleaching/reflectance before staining-reflectance stained) × 100

$\Delta R$ were obtained by averaging the readings obtained using the blue and green filters of the reflectometer.

Tea stains were used in these tests because they are considered to be the most difficult to remove of all stains.

Staining of Swatches

Tea Stain:

Four bags of Tetley tea (orange pekoe and pekoe, cut black) were added to one liter of boiling tap water (ca. 150 ppm hardness) and boiling was continued for five minutes. The tea bags were removed and 32 swatches (4 × 5 inches) of desized Indianhead cotton muslin were added and kept in the boiling tea solution for another 5 minutes. The stained swatches were removed, wrung out by hand but not rinsed, and placed in a Kenmore household clothes dryer (electric) for 30 minutes. The dried stained swatches were then rinsed under a stream of cold tap water, smoothed out, and redried in the clothes dryer for another 20 minutes. Because of a slight aging effect on the stain, it has been found best to use swatches that are at least 2 days old but not more than two weeks old. Reflectances are measured just before use in a bleaching test.

EXAMPLE 1

The improvement in stain removal effectiveness of sodium perborate by the addition of Acetate II and TACA is shown in the following table.

Table I

| Conditions | | |
|---|---|---|
| Type detergent | : | Phosphorus Tide (8.7% P) |
| Active oxygen conc. | : | 60 ppm |
| Temperature | : | 50° C |
| Activator/perborate weight ratio | : | 1/1 |
| Type stain | : | Tea |

| Activator Added | % Tea Stain Removal |
|---|---|
| Detergent blank | 25 |
| Detergent + perborate | 49 |
| Acetate II + detergent + perborate | 68 |
| TACA + detergent + perborate | 79 |

Note that the activator of this invention, while not quite as effective in stain removal as the commercial TACA, is still quite effective.

EXAMPLE 2

The storage stability of a formulation containing detergent, peroxygen and Acetate II was determined.

TABLE II

| Conditions | | |
|---|---|---|
| Formulation | : | Phosphorus Tide (8.7% P, 3.0 g) + $Na_2CO_3$ (1.2 g) + $NaBO_3.4H_2O$ (1.2 g) + Acetate II (1.2 g) |
| Conditions | : | Room temperature and humidity |

| Storage Time (Weeks) | % Tea Stain Removal 60 ppm, A.O. 50° C | |
|---|---|---|
| | Activated | Non-Activated |
| 0 | 68 | 49 |
| 10 | 70 | 51 |

EXAMPLE 3

The improvement in stain removal effectiveness of sodium perborate by the addition of the monoacetate of the adduct from the cyclopentanone and nitromethane is shown in the following table.

Table III

| Conditions | | |
|---|---|---|
| Type detergent | : | Phosphorus Tide (8.7% P) |
| Active oxygen conc. | : | 60 ppm |
| Temperature | : | 50° C. |
| Activator/perborate weight ratio | : | 1/1 |
| Type stain | : | Tea |

| Activator Added | % Tea Stain Removal |
|---|---|
| Detergent + perborate | 52 |
| Monoacetate + detergent + perborae | 68 |
| Acetate II + detergent + perborate | 71 |

Similar results are obtained to those shown in the examples when sodium carbonate peroxide is substituted for sodium perborate. Moreover, as indicated above, similar results are obtained with a wide range of detergents; the compositions are storage-stable if the detergent compositions plus peroxygen compound are storage-stable in the absence of stabilizer.

Obviously, considering the wide variety of commercially available detergents which meet the basic stability requirements, the examples can be multiplied indefinitely without departing from the scope of the invention as defined in claims.

What is claimed is:

1. A storage-stable detergent bleaching composition consisting essentially of a storage-stable mixture of a detergent and a solid active oxygen compound of the group consisting of sodium perborate and sodium carbonate peroxide, and as an activator, at least 50 molar percentage, based on active oxygen compound of 14-acetoxy-14-azadispiro[5.1.5.2]pentadec-9-ene-15-one 7-oximinoacetate.

2. A storage-stable detergent bleaching composition consisting essentially of a storage-stable mixture of a detergent and a solid active oxygen compound of the class consisting of sodium perborate and sodium carbonate peroxide, and as an activator, at least 50 molar percentage, based on active oxygen compound of the mono-acetylated derivative of the adduct of cyclopentanone and nitromethane, with a m.p. of 178° to 180° C and an empirical formula $C_{14}H_{18}N_2O_4$.

* * * * *